US007296324B2

(12) United States Patent
Lee

(10) Patent No.: US 7,296,324 B2
(45) Date of Patent: Nov. 20, 2007

(54) VACUUM CLEANER BRUSH ASSEMBLY

(75) Inventor: Byung-jo Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 543 days.

(21) Appl. No.: 10/878,562

(22) Filed: Jun. 29, 2004

(65) Prior Publication Data

US 2005/0120513 A1 Jun. 9, 2005

(30) Foreign Application Priority Data

Dec. 5, 2003 (KR) ..... 10-2003-0088202

(51) Int. Cl.
*A47I 9/04* (2006.01)

(52) U.S. Cl. ..... 15/415.1; 15/387; 15/412

(58) Field of Classification Search ..... 15/415.1, 15/383, 387, 412
See application file for complete search history.

(56) References Cited

U.S. PATENT DOCUMENTS

| | | | | |
|---|---|---|---|---|
| 3,048,877 | A | 8/1962 | Descarries | |
| 3,381,328 | A | 5/1968 | Szabo | |
| 5,351,362 | A | 10/1994 | Kramer et al. | |
| 6,101,668 | A | 8/2000 | Grey | |
| 6,550,099 | B2 * | 4/2003 | Worwag | 15/387 |
| 2002/0053114 | A1 | 5/2002 | Oh | |
| 2003/0106183 | A1 | 6/2003 | Frederick | |

FOREIGN PATENT DOCUMENTS

| | | |
|---|---|---|
| DE | 10240625 A1 | 9/2003 |
| DE | 10157017 C2 | 11/2003 |
| EP | 0509970 | 10/1992 |
| EP | 0526694 B1 | 2/1998 |
| GB | 2119046 | 11/1983 |
| JP | 6-36552 | 5/1994 |
| JP | 9-23998 | 1/1997 |
| KR | 1989-12608 | 8/1989 |
| WO | WO 01/41618 A1 | 6/2001 |

OTHER PUBLICATIONS

Russian Patent Office, Office Action issued in connection with corresponding application No. 2004123350.

European Patent Office, Search Report Issued May 2, 2006 with respect to European Patent Application No. 04254207.6 filed on Jul. 14, 2004.

(Continued)

*Primary Examiner*—Theresa T. Snider
(74) *Attorney, Agent, or Firm*—Blank Rome LLP.

(57) ABSTRACT

A locking unit of a brush assembly for use with a vacuum cleaner has a release preventing member so that if the brush assembly accidentally falls, the release preventing member conveniently keeps upper and lower housings of the assembly assembled. The brush assembly includes the upper and lower housings. A connector is secured in one of the upper and lower housings and is adapted to direct air in the upper and lower housings towards a suction force generator of the vacuum cleaner. A locking unit rotates on the connector to open and sealingly close the upper and the lower housings. The release preventing member is formed between the connector and the locking unit to prevent release of the locking unit.

13 Claims, 4 Drawing Sheets

OTHER PUBLICATIONS

Chinese Patent Office, Office Action Issued Jun. 9, 2006 with respect to Chinese Patent Application No. 200410054598.9 filed on Jul. 26, 2004.

Japanese Patent Office, Office Action issued Dec. 19, 2006, with respect to Japanese Patent Application No. 2004-153626 filed May 24, 2004.

Korean Intellectual Property Office, Office Action issued Oct. 27, 2005, with respect to Korean Patent Application No. 2003-88202 filed Dec. 5, 2003.

* cited by examiner

VACUUM CLEANER BRUSH ASSEMBLY

RELATED APPLICATION

This application claims priority to copending Korean Patent Application No. 2003-88202 filed Dec. 5, 2003, in the Korean Intellectual Property Office, which is incorporated herein in its entirety.

FIELD OF THE INVENTION

The present invention relates to a vacuum cleaner, and more particularly, to a brush assembly of a vacuum cleaner which comprises a locking reinforcement unit that secures upper and lower housings so they do not separate upon impact.

BACKGROUND OF THE INVENTION

Vacuum cleaners are generally provided with various types of auxiliary tools for more efficient cleaning. For example, an upholstery brush, which is an auxiliary tool for cleaning upholstery, such as carpet, is described in U.S. Patent Application Publication No. 2003/0106183A1, to Frederick et al.

Frederick et al. disclose a cleaner housing that has lower housing and an upper housing releasably attached to the lower housing. More specifically, the housing can be conveniently opened and closed, wherein the upper and lower housings are engaged with each other when the housing is closed, and disengaged from each other when the housing is open. The housings are sealingly engaged with each other by a latch, which includes a first latch tap with a latching surface formed at a rear portion of either the upper or lower housing, and a second latch tap with a latching surface formed opposite the first latch tap. When the upper and lower housings are closed, the latch surface of the first latch tap catches the latch surface of the second latch tap. A pressing button is formed on the first and second latch taps for releasing the first latch tap from the second latch tap to open the housing.

The conventional upholstery brush of Frederick et al. includes first and second latch taps that are locked and unlocked with each other by pressing on a pressing button. However, the first and second latch taps often separate from each other, thereby opening the housing.

SUMMARY OF THE INVENTION

Accordingly, an object of the present invention is to provide a brush assembly of a vacuum cleaner, including an upper housing and a lower housing; a connector secured in one of the upper and the lower housings to direct air inside the upper and the lower housings towards a suction force generator of the vacuum cleaner; and a locking unit rotatably engaged with the connector to open and sealingly close the upper and the lower housings by rotation.

A release preventing means is disposed between the connector and the locking unit, to prevent release of the locking unit. The connector is secured in the upper housing. The locking unit includes an annular rotatable knob body for interfitting with an outer circumference of the connector; an operation projection formed on one end of the annular rotative knob body. The locking guide rib extends from the outer circumference of the annular rotative knob body, and the locking guide rib is selectively engaged and disengaged with the lower housing depending on the rotation of the annular rotative knob body. The locking guide rib includes an opening at one side such that a part of the lower housing facing the locking guide rib passes through the opening and hooks in the inner circumference of the locking guide rib.

The release preventing means includes a release preventing projection extended from the outer circumference of the connector; and a release preventing recess formed in the inner circumference of the annular rotative knob body, opposite to the release preventing projection. The release preventing recess includes a first release preventing recess accommodating the release preventing projection when the annular rotative knob body is in a first position locking the upper and the lower housings together; and a second release preventing recess accommodating the release preventing projection when the annular rotative knob body is in a second position releasing the upper and lower housings from locking condition. The release preventing projection has substantially the same shape as the release preventing recess, and rounded at distal ends.

According to one aspect of the present invention, a brush assembly of a vacuum cleaner includes an upper housing and a lower housing; a connector secured in one of the upper and the lower housing to direct the air inside the upper and lower housings toward a suction force generator of the vacuum cleaner; a turbine assembly rotatably disposed between the upper and lower housings; a rotatable brush for agitating embedded dust of a surface being cleaned that rotates in accordance with the rotation of the turbine assembly; a locking unit rotatively disposed on the connector to releasably engage the upper and the lower housings by rotation; and a release preventing means formed between the connector and the locking unit to prevent release of the locking unit. The connector is secured in the upper housing.

The locking unit includes an annular rotatable knob body for interfitting with an outer circumference of the connector; an operation projection formed on one end of the annular rotatable knob body; and a locking guide rib extended from the outer circumference of the annular rotatable knob body, and the locking guide rib is selectively engaged and disengaged with the lower housing depending on the rotation of the annular rotatable knob body.

The locking guide rib includes an opening at one side such that a part of the lower housing facing the locking guide rib is passed through the opening and hooked in the inner circumference of the locking guide rib.

The release preventing means includes a release preventing projection extended from the outer circumference of the connector; and a release preventing recess formed in the inner circumference of the annular rotatable knob body, opposite to the release preventing projection.

The release preventing recess includes a first release preventing recess accommodating the release preventing projection when the annular rotatable knob body is in a first position locking the upper and the lower housings together; and a second release preventing recess accommodating the release preventing projection when the annular rotatable knob body is in a second position releasing the upper and lower housings from locking condition. The release preventing projection has substantially the same shape as the release preventing recess, and rounded at distal ends.

BRIEF DESCRIPTION OF THE DRAWINGS

The above aspects and features of the present invention will be more apparent by describing certain embodiments of the present invention with reference to the accompanying drawings.

DETAILED DESCRIPTION OF THE PREFERRED EMBODIMENTS

Figure 1:
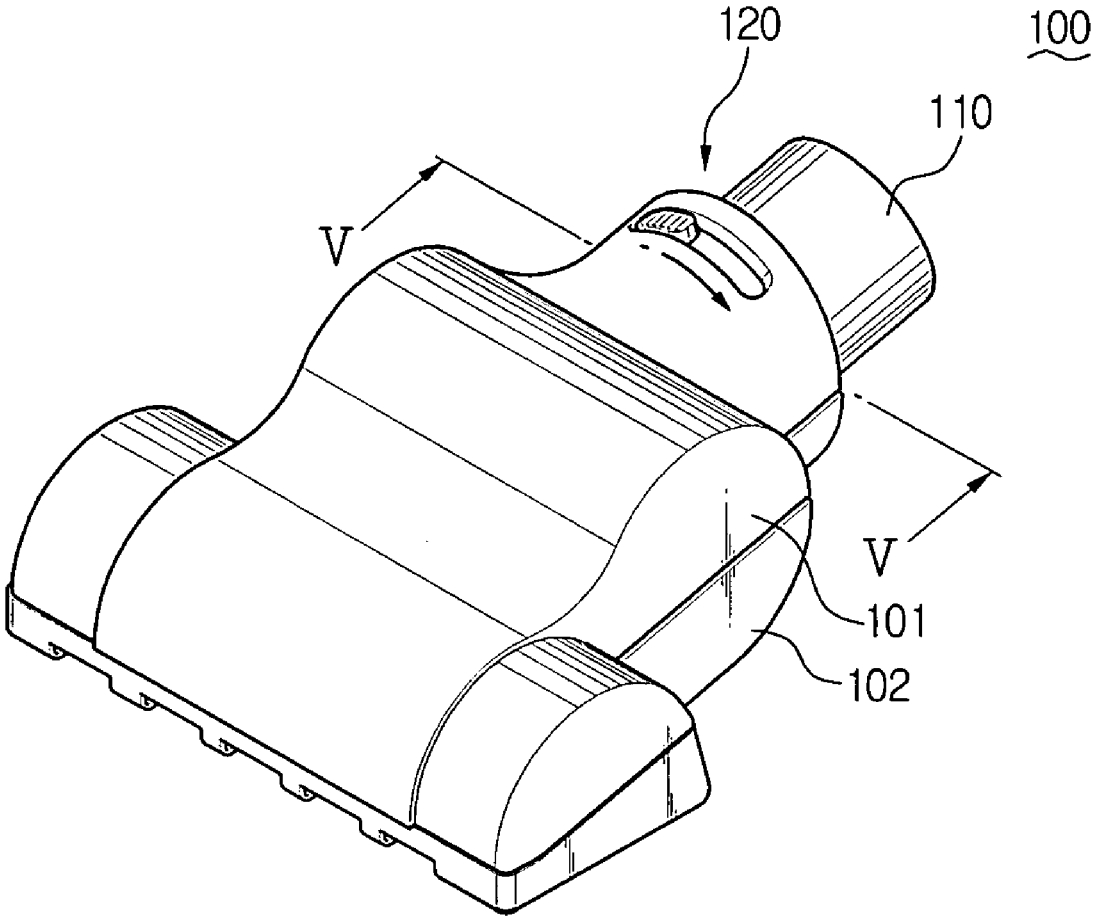
FIG. 1 is a perspective of a brush assembly of a vacuum cleaner according to an embodiment of the present invention.

In the following description, same drawing reference numerals are used for the same elements even in different drawings. The matters defined in the description such as a detailed construction and elements only provide assistance in understanding the invention. Thus, it is apparent that the present invention can be carried out without those defined matters. Also, well-known functions or constructions are not described in detail.

Additionally, while the present invention is described in the example of a turbine brush which has a rotative brush moving in accordance with a turbine assembly by the suction force of the body of the vacuum cleaner, the present invention is usable in other devices where applicable, such as in a general brush assembly.

The brush assembly 100 of a vacuum cleaner according to an embodiment of the present invention, as illustrated in FIG. 1, includes upper and lower housings 101 and 102 for releasable connection with each other, a connector 110 interposed between the upper and lower housings 101 and 102, and a locking unit 120 for securing the upper and lower housings 101 and 102 in a sealingly closed state.

Figure 2:
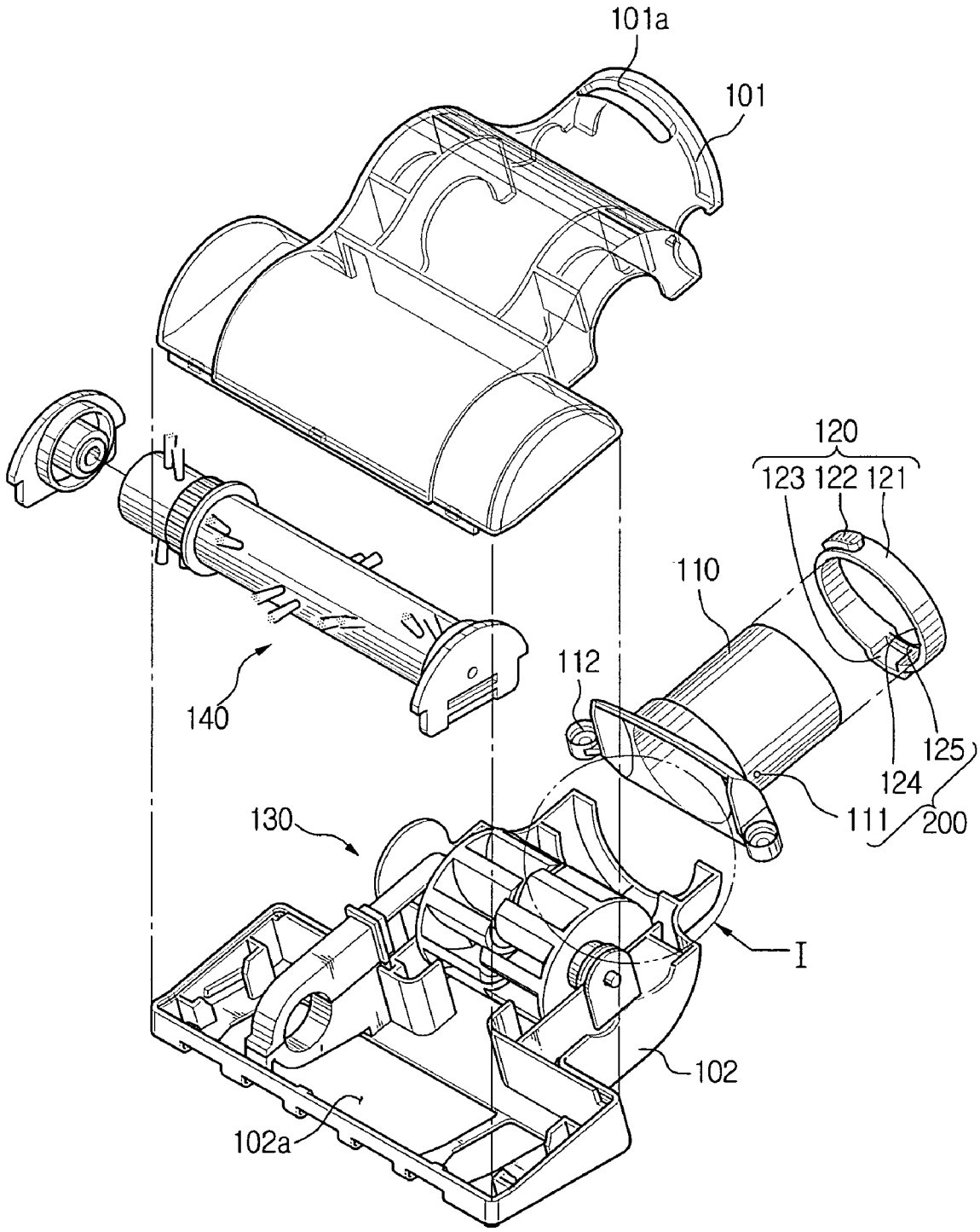
FIG. 2 is a perspective, exploded view of a brush assembly of a vacuum cleaner according to an embodiment of the present invention.

Referring to FIG. 2, the upper housing 101 forms the upper part of the brush assembly 100, and has an upwardly-extending slot 10i a exposing the locking unit 120.

The lower housing 102, with a suction port 102*a* located in the lower end thereof, houses a turbine assembly 130 which is rotatable by the suction force generated at the cleaner body (not shown). The turbine assembly 130 is engaged with a rotative brush 140 with a plurality of bristle tufts, and the rotative brush 140 rotates in accordance with the rotation of the turbine assembly 130 to scatter dust on the surface being cleaned.

The connector 110 includes a fastening part 112 on the upper case 101 for engagement with suitable fasteners, such as screws, and connects an extension pipe (not shown) of the cleaner to the brush assembly 100. The extension pipe (not shown) defines a suction passage through which air and dust of the surface being cleaned is suctioned.

Figure 4:
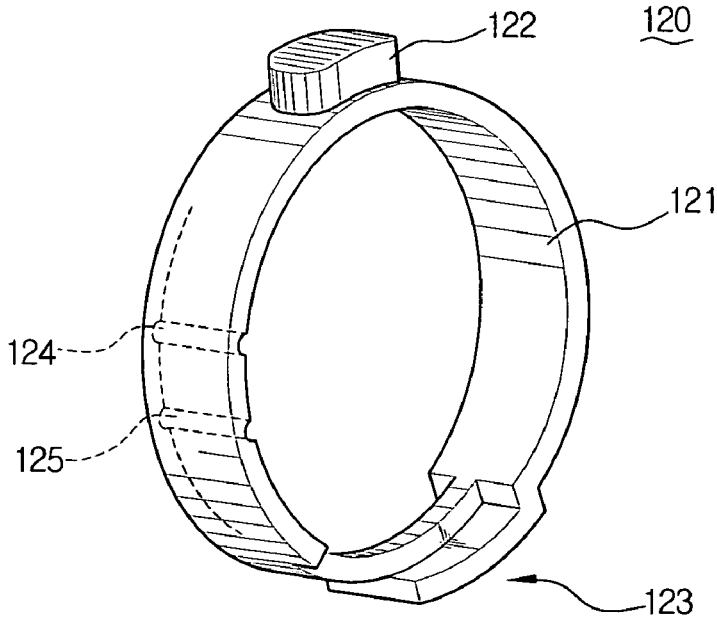
FIG. 4 is a perspective view of a locking device of a brush assembly of a vacuum cleaner according to an embodiment of the present invention.

Referring to FIGS. 2 and 4, the locking unit 120 is rotatably interfitted with the connector 110 of the extension pipe and has an annular rotative knob body 121 interfitted with the outer circumference of the connector 110, an integrally-protruding operation part 122 formed on a predetermined part of the annular rotative knob body 121, and a locking guide rib 123 protruding from the external circumference of the annular rotative knob body 121.

The annular rotative knob body 121 is substantially formed in the shape of a ring, with an inner circumference corresponding to the outer circumference of the connector 110. The integrally-protruding operation part 122 on the upper side of the annular rotatable knob body 121 engages the upwardly-extending slot 101*a* of the upper housing 101, and extends outwardly towards the brush assembly 100. Accordingly, as the user rotates the integrally-protruding operation part 122 along the inner circumference of the upwardly-extending slot 101*a*, the annular rotatable knob body 121 rotates.

Figure 3:
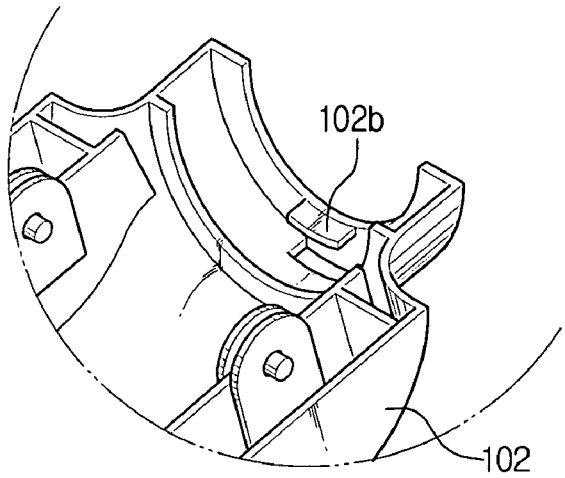
FIG. 3 is an enlarged view of the main part indicated by circle I in FIG. 2.

Referring to FIG. 2, the locking guide rib 123 extends in the proximity of the lower housing 102, opposite to the integrally-protruding operation part 122, and to a predetermined height beyond the diameter of the annular rotatable knob body 121. However, other alternatives are possible. For example, the locking guide rib 123 may extend from the side of the annular rotatable knob body 121 in alignment with a locking protrusion (FIG. 3) which is formed on the lower housing 102 corresponding to the locking guide rib 123 of the lower housing 102. The locking guide rib 123 may be open at one side so that the locking protrusion 102*b* enters along the inner circumference of the locking guide rib 123 according to the rotation of the annular rotative knob body 121.

The brush assembly 100 according to one certain embodiment of the present invention may further include a release preventing means 200 (FIG. 2) between the connector 110 and the locking unit 120. The basic purpose of the release preventing means 200 prevents the upper and lower housings 101 and 102 from separating from each other due to a sudden external impact such as if the brush assembly 100 is inadvertently dropped to the floor.

Figure 5:
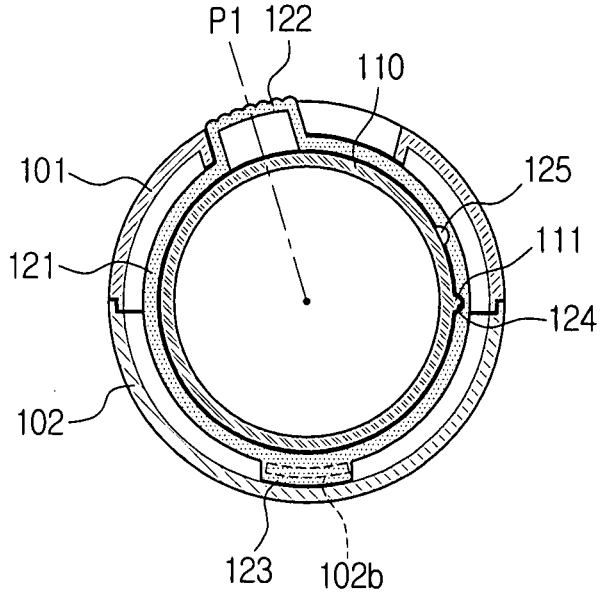
FIGS. 5 and 6 are sectional views taken along line V-V of FIG. 1, illustrating upper and lower housings of the brush assembly of a vacuum cleaner according to an embodiment of the present invention, being locked and unlocked respectively.
Figure 6:
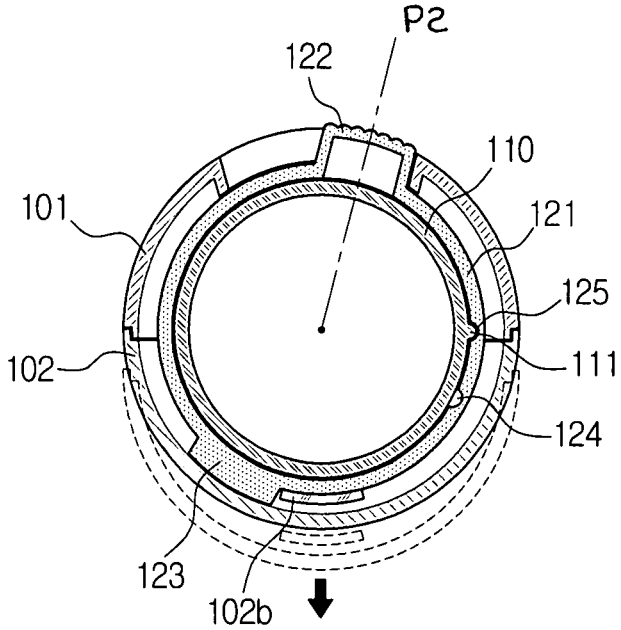

Referring to FIGS. 5 and 6, the release preventing means 200 has a release preventing projection 111 that extends from the outer circumference of the connector 110, and first and second release preventing grooves 124 and 125 formed in the inner circumference of the annular rotative knob body 121 opposite to the release preventing projection 111.

Accordingly, when the annular rotative knob body 121 is in the first position P1 locking the upper and lower housings 101 and 102 together, the first release preventing groove 124 accommodates the release preventing projection 111. When the annular rotative knob body 121 is in the second position P2 releasing the upper and lower housings 101 and 102 from the locked state, the second release preventing groove 125 accommodates the release preventing projection 111. The release preventing projection 111 is shaped to correspond to the first and the second release preventing grooves 124 and 125, and additionally, each of the grooves 124 and 125 can be rounded at one end.

According to an embodiment of the present invention, the brush assembly 100 includes the upper and lower housings 101 and 102 which are releasably engageable to each other with the turbine assembly 130 interposed between the upper and lower housings 101 and 102. The turbine assembly 130 is rotated by the vacuum suction force generated at the suction force generator of the cleaner body (not shown) such that the rotative brush 140 can, in accordance with the rotation of the turbine assembly 130, agitate embedded dust of the surface being cleaned.

During operation, and over time, contaminants and foreign substances, such as hair, can wrap around the turbine assembly 130 obstructing the rotation of the turbine assembly 130 and often requiring inspection and repair. Accordingly, the upper and lower housings 101 and 102 are releasably assembled with each other for convenient inspection and repair.

As the user rotates the locking unit 120 in the arrowed direction of FIG. 1, the upper and lower housings 101 and 102 are separated from each other to open the upper and lower housings 101 and 102.

Additionally, referring to FIG. 5, in the first position P1 where the upper and lower housings 101 and 102 are sealingly engaged with each other, the locking guide rib 123 locks the upper and lower housings 101 and 102 by the engagement with the locking protrusion 102*b*. As the integrally-protruding operation part 122 rotates in the arrowed direction of FIG. 1, the locking guide rib 123 is disengaged from the locking protrusion 102*b* (FIG. 6). In this situation, the locking unit 120 is engaged with the connector 110, and the connector 110 is securely engaged with the upper housing 101. Accordingly, as the locking protrusion 102*b* and the locking guide rib 123 are released from each other, the lower housing 102 is releasable downward, as shown in FIG. 6.

If the brush assembly 100 is dropped to the ground, the release preventing means 200 disposed between the connector 110 and the locking unit 120 prevents the separation of the upper and lower housings 101 and 102.

The release preventing means 200 includes a release preventing protuberance 111 formed on the connector 110, and first and second release preventing recesses 124 and 125 formed in the inner circumference of the annular rotable knob body 121 of the locking unit 120. In the first position P1, the release preventing projection 111 is seated in the first release preventing recess 124, and in the second position P2, the release preventing projection 111 is seated in the second release preventing recess 125. Accordingly, the annular rotative knob body 121 is restricted from rotating by a sudden external impact, and the locking guide rib 123 is prevented from disengaging from the locking protrusion 102*b*.

Referring to FIGS. 5 and 6, the user can conveniently assemble and disassemble the upper and lower housings 101 and 102 of the brush assembly 100 by rotating the locking unit 120 between the first position P1, thereby locking the upper and lower housings 101 and 102 together, and the second position P2, thereby releasing the upper and lower housings 101 and 102 from locked state. Since the locking unit 120 is held in place by the release preventing means 200, separation of the upper and lower housings 101 and 102 from each other can be avoided when the user inadvertently drops the brush assembly 100.

As described above, the disassembly of the upper and lower housings 101 and 102 is convenient because the upper and lower housings 101 and 102 are held securely in place even when the brush assembly 106 is accidentally dropped during use.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A nozzle assembly of a vacuum cleaner, comprising:

an upper housing and a lower housing;

a connector secured in the upper housing adapted to direct air in the upper and the lower housings towards a suction force generator of the vacuum cleaner; and a locking unit rotatably engaged with the connector to open and sealingly close the upper and the lower housings by rotation, and wherein the locking unit including an annular rotatable knob body for interfitting with an outer circumference of the connector, an operation projection formed on one end of the annular rotatable knob body, and a locking guide rib extending from an outer circumference of the annular rotatable knob body, and the locking guide rib being selectively engaged and disengaged with the lower housing depending on the rotation of the annular rotatable knob body.

2. The nozzle assembly of claim 1, wherein a release preventing means is disposed between the connector and the locking unit for preventing release of the locking unit.

3. The nozzle assembly of claim 1, wherein the locking guide rib includes an opening at one side such that a part of the lower housing facing the locking guide rib passes though the opening and hooks an inner circumference of the locking guide rib.

4. The nozzle assembly of claim 2, wherein the release preventing means includes:

a release preventing projection extending from the outer circumference of the connector; and a release preventing recess formed in an inner circumference of the annular rotatable knob body opposite to the release preventing projection.

5. The nozzle assembly of claim 4, wherein the release preventing recess includes:

a first release preventing recess accommodating the release preventing projection when the annular rotatable knob body is in a first position locking the upper and the lower housings together; and a second release preventing recess accommodating the release preventing projection when the annular rotatable knob body is in a second position releasing the upper and lower housings from locking condition.

6. The nozzle assembly of claim 4, wherein the release preventing projection has substantially the same shape as the release preventing recess and is rounded at its distal ends.

7. The nozzle assembly of claim 5, wherein the release preventing projection has substantially the same shape as the release preventing recess and is rounded at its distal ends.

8. A nozzle assembly of a vacuum cleaner, comprising:

an upper housing and a lower housing;

a connector secured in the upper housing adapted to direct air inside the upper and the lower housings towards a suction force generator of the vacuum cleaner;

a turbine assembly rotatably disposed between the upper and the lower housings;

a rotatable brush for agitating dust of a surface to be cleaned, the rotatable bush rotating with the rotation of the turbine assembly;

a locking unit rotatably disposed on the connector adapted to releasably engage the upper and the lower housings, the locking unit including an annular rotatable knob body that interfits with an outer circumference of the connector, an operation projection fonned on one end of the annular rotatable knob body, and a locking guide rib extending from an outer circumference of the annular rotatable knob body, and the locking guide rib engaging and disengaging with the lower housing depending on the rotation of the annular rotatable knob body; and a release preventing member formed between the connector and the locking unit adapted for preventing release of the locking unit.

9. The nozzle assembly of claim 8, wherein the locking guide rib includes an opening at one side such that a part of the lower housing facing the locking guide rib passes through the opening and hooks in to an inner circumference of the locking guide rib.

10. The nozzle assembly of claim 8, wherein the release preventing member includes:

a release preventing projection extending from the outer circumference of the connector; and a release preventing recess formed in an inner circumference of the annular rotatable knob body opposite to the release preventing projection.

11. The nozzle assembly of claim 10, wherein the release preventing recess includes:

a first release preventing recess accommodating the release preventing projection when the annular rotatable knob body is in a first position locking the upper and the lower housings together; and a second release preventing recess accommodating the release preventing projection when the annular rotatable knob body is in a second position releasing the upper and lower housings from locking condition.

12. The nozzle assembly of claim 10, wherein the release preventing projection has substantially the same shape as the release preventing recess and is rounded at its distal ends.

13. The nozzle assembly of claim 11, wherein the release preventing projection has substantially the same shape as the release preventing recess and is rounded at its distal ends.

* * * * *